US006146502A

United States Patent [19]

Marx

[11] Patent Number: 6,146,502

[45] Date of Patent: Nov. 14, 2000

[54] PAPER MAKING MACHINE WITH A TRAVELING DECKLE BOARD

[75] Inventor: Edmund N. Marx, St. Mary's, Ga.

[73] Assignee: XRAM, Inc., St. Mary's, Ga.

[21] Appl. No.: 09/233,233

[22] Filed: Jan. 19, 1999

[51] Int. Cl.[7] ..... D21F 1/58; D21F 1/04; D21F 1/10; D21F 1/00; D21F 1/32

[52] U.S. Cl. ..... 162/353; 161/334; 161/348; 161/354; 161/274; 161/199; 161/355

[58] Field of Search ..... 162/199, 272, 162/274, 334, 348, 353, 354, 355

[56] References Cited

U.S. PATENT DOCUMENTS

| | | | |
|---|---|---|---|
| 424,159 | 3/1890 | Ackley | 162/334 |
| 1,712,632 | 5/1929 | Peterson et al. | 162/334 |
| 4,718,983 | 1/1988 | Ibrahim | 162/252 |

FOREIGN PATENT DOCUMENTS

| | | | |
|---|---|---|---|
| 169718 | 6/1934 | Switzerland | 162/353 |

*Primary Examiner*—James Derrington
*Assistant Examiner*—Dionne A. Walls
*Attorney, Agent, or Firm*—Arthur G. Yeager

[57] ABSTRACT

A machine for adjustably placing a low dam moving along each lateral edge of a Fourdrinier fabric so as to contain the paper-making slurry on the fabric without leaking over the edges of the fabric while the moving fabric is subjected to sufficient suction treatment to render the slurry immobile on the fabric. The principal object of this invention is to maintain the slurry in a steady flow pattern substantially free of any waves while the slurry is forming a self-supporting paper web.

20 Claims, 5 Drawing Sheets

PAPER MAKING MACHINE WITH A TRAVELING DECKLE BOARD

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

FIELD OF THE INVENTION

This invention relates to the art of paper-making, and more specifically, it relates to a novel structure employed to contain the aqueous paper-making stock leaving the head box and flowing onto the traveling screen. In particular, a structure called a "deckle board" is caused to travel along with the lateral edges of the screen for a distance sufficient to allow the liquid stock to drain through the screen to form a solid mat, and then to cause the deckle board to be removed from contact with the edges of the screen.

DESCRIPTION OF RELATED ART INCLUDING INFORMATION DISCLOSED UNDER 37 CFR 1.97 AND 37 CFR 1.98

British Patent 468,527 discloses the use of traveling deckle straps along the lateral edges of the paper-making web immediately following the introduction of the pulp slurry onto the web. The belt is pulled by the moving web and has no independent movement of its own. The belt is not positioned to contain all of the slurry on the web; some of it leaks out the lateral edges. U.S. Pat. No. 1,734,929 teaches the use of a heavy belt positioned perpendicular to the paper-making web, and at times, with a stationary deckle board on top of the belt. The belt does not exactly match the web and leaks from the web occur. The belt is pulled by the web and has no movement of its own. The use of such a device has proven to be limited to slow speeds. Other patents such as U.S. Pat. Nos. 231,169; 407,534; 742,239; 1,581,655; and 1,898,372 are similar in operation to U.S. Pat. No. 1,734,929, described above. None of the prior art patents show any means for keeping the belt pressed against the web so as to form a tight, nonleaking joint.

BRIEF SUMMARY OF THE INVENTION

This invention provides a pair of parallel deckle belt means movable from an operational position to a nonoperational position; the belt means including an endless belt driven around two spaced pulleys at an adjustable speed adapted to match the speed of the Fourdrinier fabric at the slice, positioning the belt to form a nonleaking junction with the fabric from the first contact between the slurry and the fabric to a short distance downstream where the liquid slurry has been transformed into a solid self-supporting web of paper on the fabric; said belt means being movable between the limits of (1) an operational position where said belt contacts said fabric which is then flooded with an aligned flow of paper-making slurry at the slice and (2) a nonoperational position where said belt is lifted above and out of contact with said fabric for servicing and positioning operations. This invention eliminates the forces producing waves in the slurry, which, in turn, produces an uneven weight profile in the paper web.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
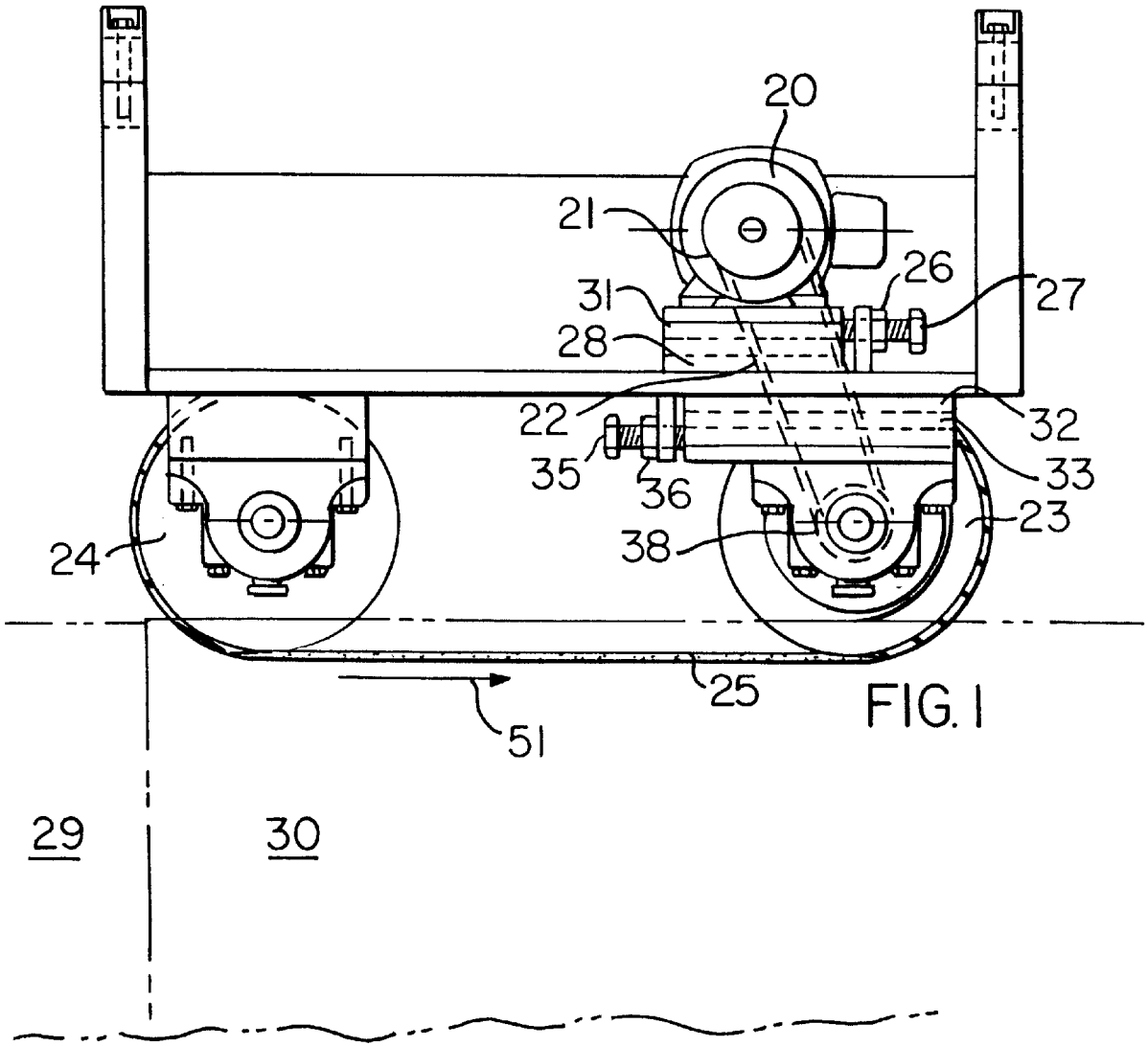
FIG. 1 is a top plan view of the traveling deckle board of this invention.

This invention relates to the modern process of manufacturing paper from an aqueous slurry of cellulosic fibers which are deposited on a traveling horizontal fabric; the process being usually referred to as the "Fourdrinier" process. Furthermore this invention relates to the first portion of the process, sometimes called the "Fourdrinier section" or the "wet end", where the papermaking slurry of about 99.5% water and 0.5% cellulose fibers is first spread over the fabric and water is sucked downward through the fabric so as to leave a damp deposit of cellulosic fibers on the fabric to be dried sufficiently so as to be pulled off the fabric in the form of a sheet of paper. The machine of this invention is employed to keep the slurry on top of the traveling fabric until sufficient water is removed to form the cellulosic fibers into a fragile sheet supported on the Fourdrinier fabric. The machine of this invention provides a low wall that moves at the same speed as the fabric and prevents the slurry from running off the edges of the traveling fabric until the damp paper sheet is formed and no water remains to run off the edges. The low wall which keeps water from running off the edges of the moving fabric has been employed in the past and has become known as a "deckle board". Various modifications of the deckle board have been proposed and tried in the past, some of which are described above. None have been entirely satisfactory, generally because the deckle boards have allowed leaks to occur and thereby have caused the edges of the paper to be thin where the leaks occurred. The present invention employs an endless belt which can be placed against the edge of the paper-making fabric and adjusted in speed to match that of the fabric, and made to stay in contact with the fabric long enough to minimize any loss of water and detach itself from the fabric as soon as the damp paper is strong enough to support itself and not fall apart. The slurry exiting the head box 29 contacts the moving belt 25 moving in the direction of arrow 51 and spreads evenly across fabric 30 without producing any uneven weight profile of fibers across the fabric. The resultant sheet of paper has a uniform consistency. When the deckle board is kept stationary a severe wave is generated which produces an uneven weight profile of fiber in the paper. Because corrections and adjustments must always be made to meet unexpected conditions, the present invention provides a moving "deckle board" mounted on a pivoting support so as to permit instantaneous removal of deckle board 25 from the fabric 30 and subsequently instantaneous return to its production location at the edge of fabric 30. This permits ease of adjustment for whatever reason.

Figure 3:
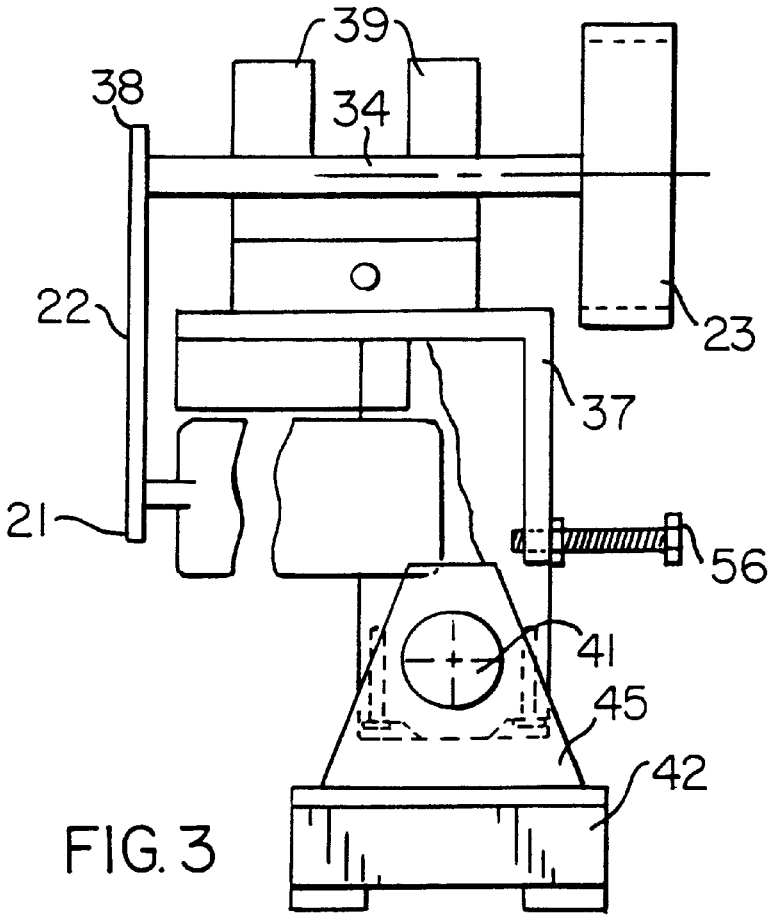
FIG. 3 is the same elevational view as that of FIG. 2 when rotated to the "off position".
Figure 2:
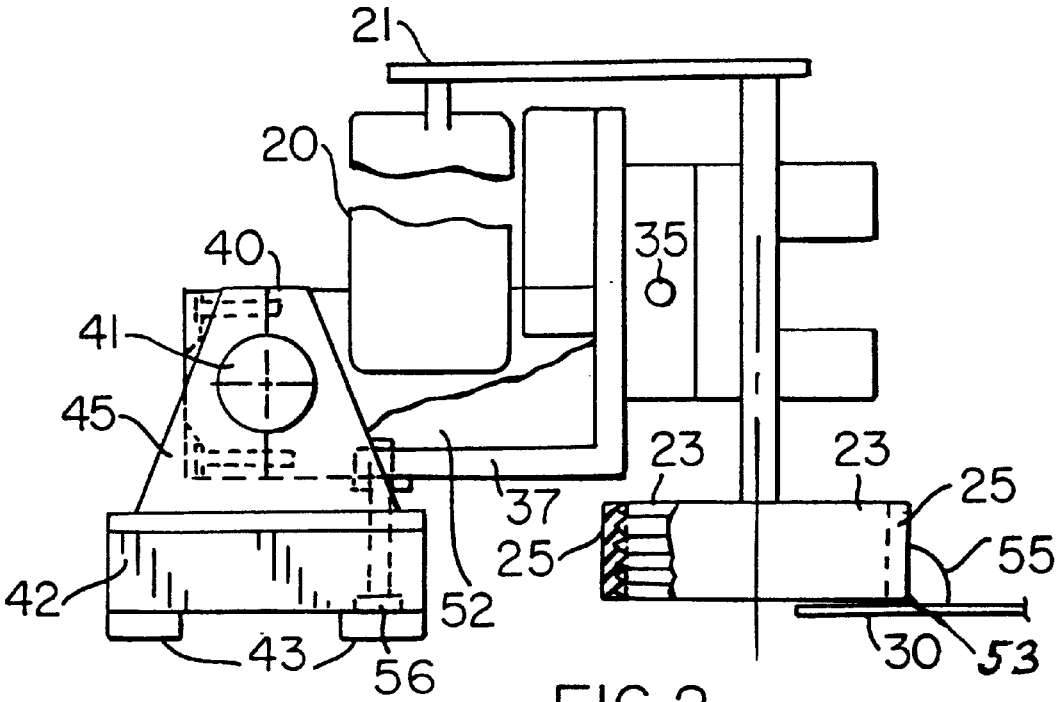
FIG. 2 is an end elevational view of the deckle board of this invention in the "running position"
Figure 4:
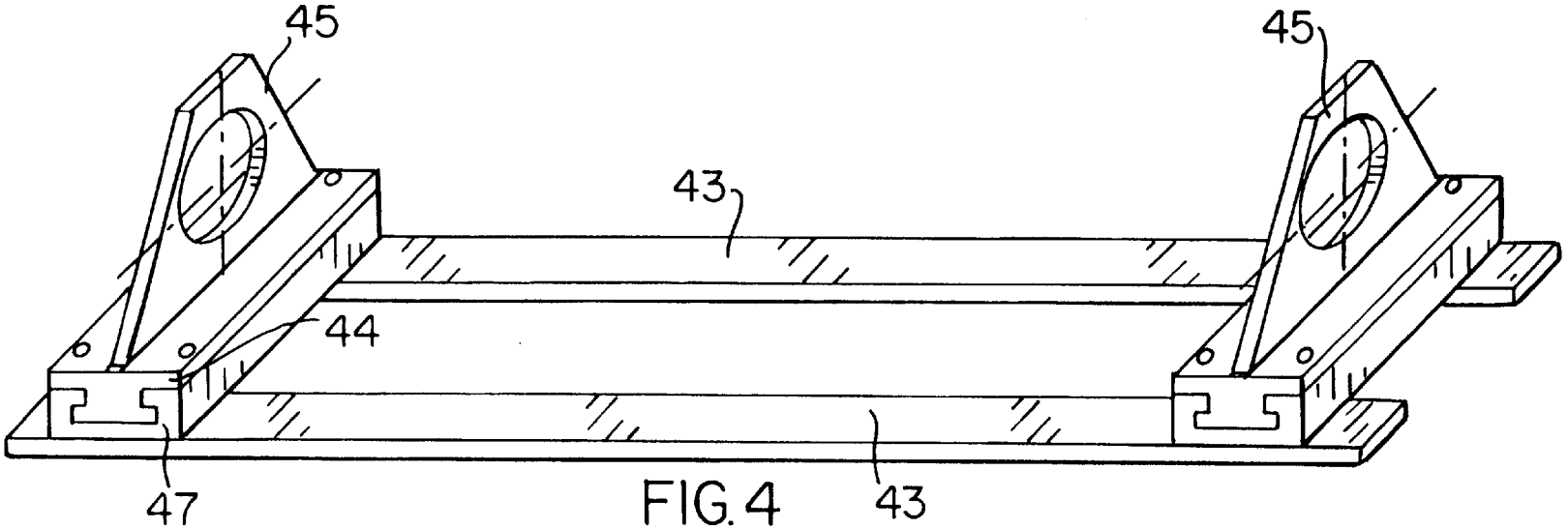
FIG. 4 is a perspective view of the supporting structure for the traveling deckle board of FIGS. 1–3 slowing its axis for rotation.

In FIGS. 1–3 there are shown the principal features of the machine of this invention. A continuous belt 25 which serves as a moving deckle board is driven about a driving pulley or roll 23 and a driven pulley or roll 24. The outside surface of belt 25 is smooth and the inside surface is a tongue-and-groove configuration to match the tongue-and-groove outside surface of rolls 23 and 24. This sawtooth shape substantially eliminates slippage and thereby permits the smooth outside surface to form a smooth edge for the paper being produced. The grooved rolls and grooved pulleys can be so well adjusted that guidance of the critical edge of the belt is not a problem. Driving roll 23 is, in turn, driven by motor 20 with driving belt 22 around motor pulley 21 and roll pulley 38. Motor 20 and rolls 23 and 24 and associated equipment are mounted on L-frame base 37 which, in turn, is pivotally mounted supported on support shaft 41 on stationary machine base 42. When the machine is in the "running" position as indicated in FIG. 2, belt 25 is in contact with fabric 30 and prevents any leaking of the fiber slurry. When the machine is in the "off" position as shown in FIG. 3 belt 25 is not in contact with fabric 30 by reason of the fact that frame base 37 and all equipment attached thereto has been pivoted 90 degrees about shaft 41. It should be noted that belt 25 extends outwardly beyond the working edge of roll 23 so that only the edge of belt 25 touches fabric 30 and not the edge of roll 23. The deckle belt 25, as seen in FIGS. 1 and 2, has a return or inoperative portion spaced outwardly of the fabric 30 which is slightly elevated above the plane of the fabric 30. Of course, when a deckle belt 25 is employed on each of the side edges of fabric 30, the return portions face oppositely from each other and are disengaged from fabric 30 at all times. This feature materially lengthens the life of fabric 30 and belt 25 by eliminating the abrasion that would occur if the edge of roll 23 rubbed against fabric 30 as well as belt 25. Belt 25 and roll 23 are actually tilted at angle 55 (about 1 degree) so as to eliminate any touching of the belt to the fabric 30 except along a line where the edge of belt 25 touches fabric 30. The only possible friction occurs where the belt 25 first touches fabric 30 and where it leaves fabric 30 for its return to complete the loop of travel.

The necessary adjustment features are provided by slide base 28, adjustable slide 31, locking nut 26, and adjustment bolt 27 for motor 20; and similarly, by slide base 32, adjustable slide 33, adjustment bolt 35, and locking nut 36 for grooved roll 23 and pulley 38. There also is stop bolt 56 that is adjustable to provide the proper angle between belt 25 and fabric 30 when in the running position of FIG. 2.

In FIGS. 4–8 there is shown the structure of the machine base, labeled simply as 42 in FIGS. 1–3. Machine base 42 includes two spaced parallel base strips 43 joined to two shaft supporting structures. The shaft supporting structures are identical supports for shaft 41 which is the central axis about which the machine of this invention rotates. The shaft supporting structures include a mounting base 44 resting on a cross-support 47 and supporting upwardly extending eye-plate 45 upon which rests shaft 41.

FIGS. 9–13 illustrate the complete machine of this invention, which is the combination of the machine of FIGS. 1–3 mounted rotatably on the support structure of FIGS. 4–8. The machine of FIGS. 1–3 is supported by two spaced support arms 52 and its caps 40 which, in turn, are attached rotatably to shaft 41 of FIGS. 4–8 by way of being affixed to L-frame base 37.

It may be seen that the traveling belt 25 forms a short wall on both lateral edges of the traveling fabric 30 allowing the paper web to form with no disturbing influences. If all goes well the traveling wall formed by belt 25 continues to function throughout long periods of time because the wall is continuously being established, used, and removed over the first several feet of the paper making process. Furthermore, if any malfunction should occur along the edges of the newly formed paper web the entire edge-sealing machine of this invention can be instantaneously lifted up and away from the paper web, e.g., by the action of hydraulic or pneumatic cylinders until the malfunction can be corrected, and then the machine can be instantaneously restored to its edge-sealing position.

It is also a preferable in the use of this machine to minimize the destructive wear-and-tear which this machine might inflict upon the fabric of the paper-making web. The contact between belt 25 and fabric 30 can be minimized by tilting the axes of rolls 23 and 24 so that belt 25 contacts fabric 30 along a line rather than in a plane. By tilting axle 34 about 1 degree toward the center of fabric 30 contact 53 (see FIG. 2) between belt 25 and fabric 30 will be reduced to a line contact eliminating all scuffing as belt 25 cuts across fabric 30 as it leaves driven roll 24 and comes into contact with fabric 30 and at the downstream end where it comes away from fabric 30 to follow the surface of driving roll 23.

Figure 12:
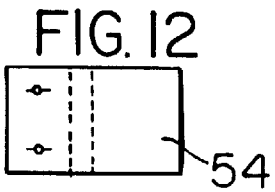
FIGS. 12–13 show two views of the transition piece used to guide the grooved belt 25 as it joins the edge of the traveling screen.
Figure 13:
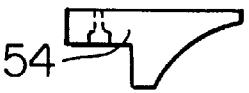
Figure 8:
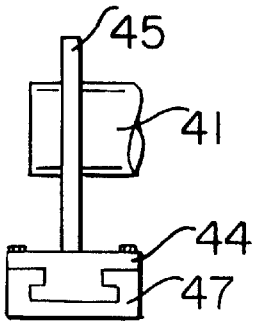
FIG. 8 is a cross-sectional view of a portion of the supporting structure of FIGS. 4–6.
Figure 7:
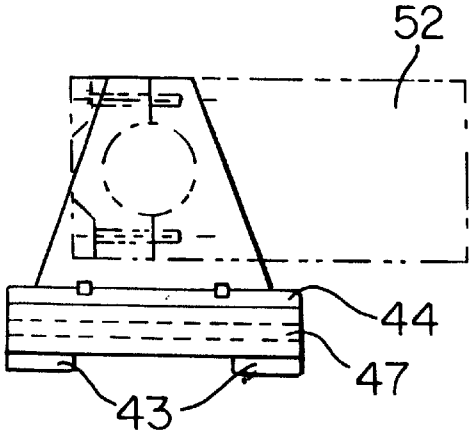
FIG. 7 is an end elevational view of the connection between the supporting structure of FIGS. 4–6 to the traveling deckle board of FIGS. 1–3.
Figure 5:
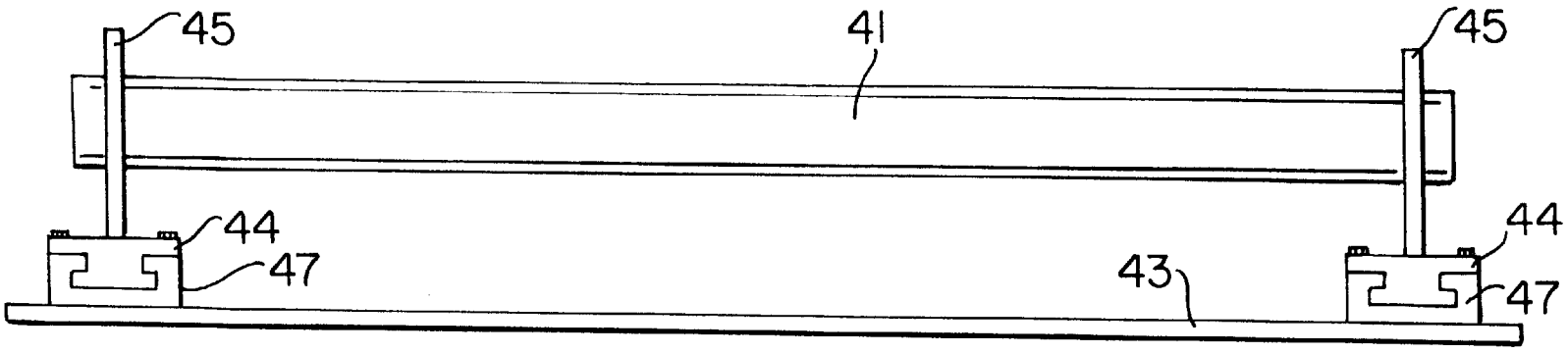
FIG. 5 is a front elevational view of the supporting structure of FIG. 4.
Figure 6:
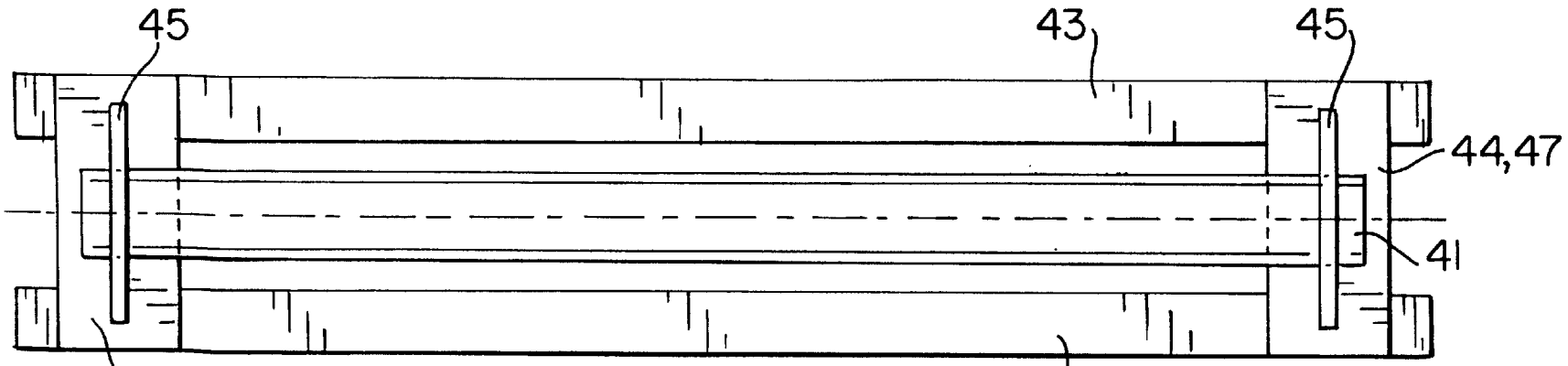
FIG. 6 is a top plan view of the supporting structure of FIGS. 4 and 5.

FIG. 12–13 are two views of a transition piece 54 shown in FIG. 13 to be lying close to driven roll 24. The purpose of transition piece 54 is to minimize the turbulence produced when the wet slurry from the head box 29 contacts the grooved belt 25 coming around driven roll 24 to form the low edge wall that keeps the slurry on the fabric as it is sucked through the fabric to form the paper film. Without the presence of transition piece 54 the slurry flow parallel to the "travel" direction of belt 25 would be met at roll 24 with a belt traveling perpendicular to the "travel" direction until the belt 25 eventually assumed the parallel direction, and this short distance might result in eddy currents in the slurry which would be contrary to the desired calm flow needed to produce a uniform paper density. The shape of the transition piece 54 extends the straight line of belt 25 farther upstream close to the exit from head box 29 and fills in the space where belt 25 moves across the flowing slurry exiting the head box. The exact position of the transition piece 54 is adjustable by the operator to provide the maximum dampening of turbulence in the wet slurry so as to produce the smoothest sheet of paper. At the high speeds of modern paper-making machines, e.g., 1000 fpm the transition piece 54 may not be needed if the rushing slurry bridges the small gap covered by transition piece 54. Nevertheless transition piece 54 is provided to prevent turbulence if it is needed. Any suitable framework may be used to appropriately position transition piece 54 with respect to the fabric 30, head box 29 and belt 25. Such framework may be connected to mounting base 47.

Figures 9, 10, 11:
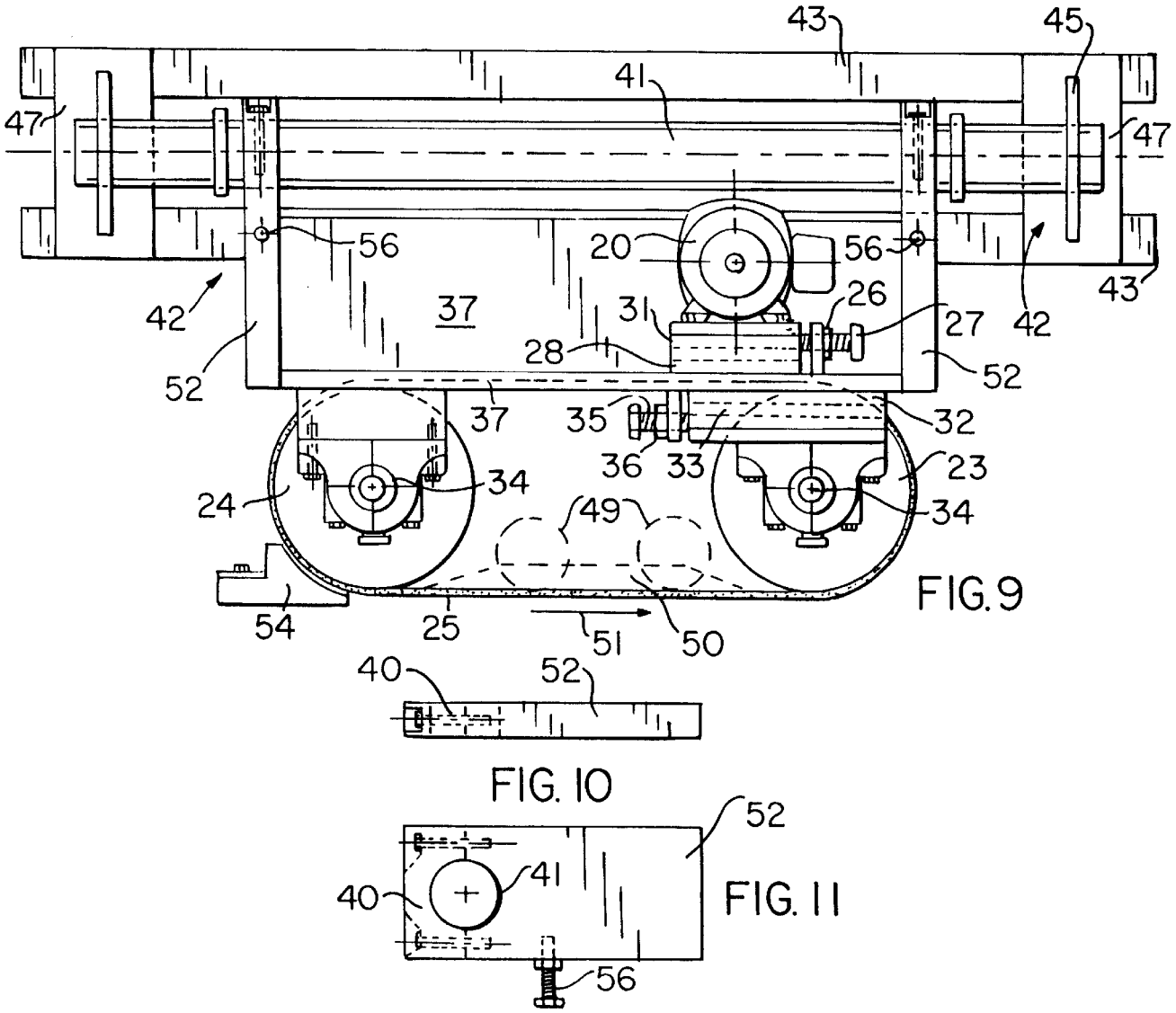
FIG. 9 is a top plan view of the assembled traveling deckle board of this invention.
FIGS. 10 and 11 show two views of the connecting arm 52 of the deckle board structure of FIGS. 1–3 to the supporting base of FIGS. 4–6.

There are shown in FIG. 9 two alternative improvements which may be of assistance in preparing a smooth paper deposit from the slurry. These are embodied in rolls 49 and stabilizer bar 50. It sometimes happens that belt 25 develops vibrations, which clearly are not desired in the paper-making process where a steady deposit of fibers is necessary to produce a quality paper product at a high rate of production. In any event, should such vibrations occur they may be eliminated by the smoothing effect of spaced idler rolls 49 pressing against grooved belt 25, or stabilizer bar 50 pressing outwardly against belt 25. The rolls 49 or stabilizer bar 50 may be biased against the inside surface of belt 25.

Various other features of this invention may be modified in a wider sense in order to meet certain special conditions or changes visualized in the operation of this invention. For example, pulleys 23 may be made to a slightly different design in order to be larger or smaller, and thereby better set the speed of belt 25, and better match the speed of paper-making web 38. There may be other reasons to change the speed of belt 25 above or below the speed of web 38. The sizes and speeds of other parts of the machine may, of course, be modified for other reasons, such as because the operator chooses to feel his way along through several speeds until he finds the preferred combination.

While the invention has been described with respect to certain specific embodiments, it will be appreciated that many modifications and changes e.g., splash guards and cleaning showers may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a Fourdrinier paper-making machine, the improvement comprising a pair of parallel deckle belt means defining the lateral limits of the liquid paper-making stock as it exits from the head box onto a Fourdrinier fabric and for a short distance downstream from said head box, each said deckle belt means including an endless taut loop of movable deckle belt about two spaced pulleys to provide a movable wall positioned normal to the plane of said Fourdrinier fabric supporting said paper-making stock as it leaves said head box, variable speed motor means for driving one of said two spaced pulleys of each said deckle belt means, said movable wall being flexible and substantially impermeable to said liquid paper-making stock and being driven by said motor means to travel at substantially the same linear speed as that of said Fourdrinier fabric, said deckle belt means being adjustable in position so as to be rapidly movable from an operable position where said movable wall between said pulleys only touches said Fourdrinier fabric and prevents any material leakage laterally from said liquid paper-making stock resting on said fabric to an inoperable position where said movable wall does not touch the liquid paper-making stock on said fabric nor said fabric.

2. The machine of claim 1 wherein said deckle belt means and said two spaced pulleys are configured with mating surfaces of a plurality of sawtooth tongues and grooves.

3. The machine of claim 1 further comprising a stabilizer bar generally spanning the space between said two spaced pulleys and engaged against said belt on its inner surface.

4. The machine of claim 1 wherein said two spaced pulleys include an upstream pulley and a downstream pulley, said upstream pulley being located in close proximity to the entranceway for paper-making slurry to flow from the head box to the Fourdrinier fabric, said machine further including a flow directing vertically extending shield upstream from said upstream pulley to maintain the flow of slurry from the head box to said deckle belt means in a single downstream direction and in the absence of any eddy currents normal to said downstream direction, and in the absence of any wave in the surface of the paper-making stock on said fabric.

5. The machine of claim 1 which includes vibration dampening means bearing against the inside surface of said deckle belt means and pressing outwardly so as to tighten said deckle belt means in the span between said two spaced pulleys and along the edge of said belt means that contacts the paper-making stock resting on said Fourdrinier fabric.

6. The machine of claim 5 wherein said vibration dampening means includes at least one pulley bearing outwardly against the inside surface of said deckle belt means at a position substantially midway between said two pulleys.

7. The machine of claim 5 wherein said vibration dampening means includes a heavy, long inflexible object pressing outwardly against the inside surface of said deckle belt means at a position substantially midway between said two pulleys.

8. The machine of claim 1 wherein each of said pair of spaced pulleys comprises an upstream pulley and a downstream pulley, said upstream pulley being located in close proximity to an entranceway for paper-making slurry to flow from a head box to said Fourdrinier fabric, said machine further/including a flow directing vertically extending shield adjacent said upstream pulley to maintain the flow of slurry from the head box to said deckle belt means in a single downstream direction and in the absence of any eddy currents normal to said downstream direction, and in the absence of any wave in the surface of the paper-making stock on said fabric.

9. The machine of claim 1 further comprising vibration dampening means bearing against the inside surface of said deckle belt means and pressing outwardly so as to tighten said deckle belt means in said span between said pair of spaced pulleys and along the edge of said belt means that contacts the paper-making stock resting on said Fourdrinier fabric.

10. The machine of claim 9 wherein said vibration dampening means includes at least one pulley bearing outwardly against the inside surface of said deckle belt means at a position substantially midway between said two pulleys.

11. The machine of claim 10 wherein said vibration dampening means includes a heavy, long, inflexible object pressing outwardly against the inside surface of said deckle belt means at a position substantially midway between said two pulleys.

12. In a Fourdrinier paper-making machine, the improvement comprising a pair of parallel deckle belt means defining lateral limits of liquid paper-making stock as it exits from a head box onto a Fourdrinier fabric and for a short distance downstream from said head box, each said deckle belt means including an endless taut loop of deckle belt driven by one of a pair of spaced pulleys to provide a movable wall positioned normal to a horizontal plane of said Fourdrinier fabric supporting said paper-making stock as it leaves said head box, each said movable wall being flexible and substantially impermeable to said liquid paper-making stock, power means to drive said one pulley such that said wall moves at substantially the same linear speed as said Fourdrinier fabric, said deckle belt means being rapidly and movably adjustable between operable and inoperable positions, said operable position being a juxtaposed contact only between said movable wall and said Fourdrinier fabric to prevent any material leakage laterally from said liquid paper-making stock on said fabric, said inoperable position being a moved position with said movable wall being adjacent said Fourdrinier fabric.

13. In the machine of claim 12 wherein said operable position locates said deckle belt means tilted at an angle to a vertical plane of at least 1 degree so that said movable wall barely engages said fabric and yet does prevent leakage laterally from said fabric without materially abrading said fabric.

14. In the machine of claim 13 wherein each said deckle belt has an operative portion facing each other and a return portion facing oppositely from each other, said return portion of each said deckle belt being disengaged from said fabric at all times.

15. In the machine of claim 12 wherein each said deckle belt and each said pair of spaced pulleys are configured with mating surfaces formed of a plurality of spaced tongues and grooves.

16. In the machine of claim 12 further comprising a stabilizer bar generally spanning a space between said two spaced pulleys and engaged against said belt on its inner surface.

17. In a Fourdrinier paper-making machine, the improvement comprising a pair of parallel deckle belt means defining the lateral limits of the liquid paper-making stock as it exits from the head box onto a Fourdrinier fabric and for a short distance downstream from said head box, each said deckle belt means including an endless taut loop of movable deckle belt about two spaced pulleys to provide a movable wall positioned normal to the plane of said Fourdrinier fabric supporting said paper-making stock as it leaves said head box motor means for driving one of said two spaced pulleys of each said deckle belt means, said movable wall being flexible and substantially impermeable to said liquid paper-making stock and being driven by power means to travel at substantially the same linear speed as that of said Fourdrinier fabric, said deckle belt means being adjustable so as to be rapidly movable from an operable position where said movable wall touches said Fourdrinier fabric and prevents any material leakage laterally from said liquid paper-making stock resting on said fabric to an inoperable position where said movable wall does not touch said fabric, said operable position of said deckle belt means being tilted at an angle to the vertical of at least 1 degree so that said movable wall barely touches said fabric and yet does prevent leakage laterally from said fabric without materially abrading said fabric while said deckle belt has its return portion slightly elevated above said fabric.

18. The machine of claim 17 wherein said deckle belt means and said two spaced pulleys are configured with mating surfaces of a plurality of sawtooth tongues and grooves.

19. The machine of claim 17 wherein said two spaced pulleys include an upstream pulley and a downstream pulley, said upstream pulley being located in close proximity to the entranceway for paper-making slurry to flow from the head box to the Fourdrinier fabric, a flow directing vertically extending shield between said upstream pulley and the head box to maintain the flow of slurry from the head box to said deckle belt means in a single downstream direction and in the absence of any eddy currents normal to said downstream direction, and in the absence of any wave in the surface of said slurry.

20. The machine of claim 17 which includes vibration dampening means bearing against the inside surface of said deckle belt means and pressing outwardly so as to tighten said deckle belt means in the span between said two spaced pulleys and along the edge of said belt means that contacts said paper-making stock resting on said Fourdrinier fabric.

* * * * *